US006846244B1

(12) United States Patent
Davis

(10) Patent No.: US 6,846,244 B1
(45) Date of Patent: Jan. 25, 2005

(54) METHOD OF PLAYING A GAME WITH A TELESCOPIC PUTTER MOUNTED TO HEADBAND

(76) Inventor: Edward E. Davis, 319 Kit Horne Rd., Whiteville, NC (US) 28472-8177

( * ) Notice: Subject to any disclaimer, the term of this patent is extended or adjusted under 35 U.S.C. 154(b) by 0 days.

(21) Appl. No.: 10/839,273

(22) Filed: May 6, 2004

Related U.S. Application Data

(62) Division of application No. 10/456,257, filed on Jun. 9, 2003.

(51) Int. Cl.[7] ..... A63B 53/00

(52) U.S. Cl. ..... 473/208; 473/239; 473/296; 473/409

(58) Field of Search ..... 473/207–211, 239, 473/296, 294–295, 298, 409; 224/181; 401/6

(56) References Cited

U.S. PATENT DOCUMENTS 3,824,022 A * 7/1974 Mancino ..... 401/6
3,880,431 A * 4/1975 Swanson ..... 473/139
4,298,201 A * 11/1981 Palinkas ..... 473/210
4,399,994 A * 8/1983 Hourihan ..... 473/208
4,786,966 A * 11/1988 Hanson et al. ..... 348/158
4,971,325 A * 11/1990 Lipps ..... 473/209
5,342,055 A * 8/1994 Diley ..... 473/208
5,688,184 A * 11/1997 Johnson ..... 473/229

* cited by examiner

*Primary Examiner*—Stephen Blau
(74) *Attorney, Agent, or Firm*—John D. Gugliotta; Olen L. York, III

(57) ABSTRACT

A telescopic putter mounted to a headband is a novelty game that mimics the game of golf. It is played indoors with a lightweight plastic ball and a cup resting on the floor. The game follows the general rules of putt-putt golf, except for the rule that the player must not touch the club with their hands when swinging. Instead the club is attached to the player's head with the use of a headband. Thus, the player must bend over the ball, place their hands on their knees and swing the club by turning their head from side to side. The club has an adjustable length shaft that telescopes in and out to accommodate players of varying heights.

7 Claims, 5 Drawing Sheets

METHOD OF PLAYING A GAME WITH A TELESCOPIC PUTTER MOUNTED TO HEADBAND

RELATED APPLICATIONS AND DISCLOSURES

This application is a divisional of prior U.S. application Ser. No. 10/456,257, filed on Jun. 09, 2003.

BACKGROUND OF THE INVENTION

1. Field of the Invention

The present invention relates generally to golf, and more particularly to a telescopically adjustable golfing putter mounted to a headband for use in a golfing game.

2. Description of the Related Art

Golf is a sport growing in popularity. Everyone, from the very young who play putt-putt, to young adults and seniors, hit the links whenever there is free time available. However, the sport is primarily a warm weather activity played outdoors. This limits playing time to only a few months of the year in many locations. Also, there are many people, due to age or physical limitations, that are unable to get out and play golf, but still enjoy putting. Finally, the skill levels in a group of people of assorted ages, such as a family, varies widely, and causes those with less skills to have less of a good time. Accordingly, there is a need for a means by which not only the game of golf can be played indoors or outdoors, but can be played in a manner that levels the playing field for everyone, no matter age, size or skill.

A search of the prior art did not disclose any patents that read directly on the claims of the instant invention; however, the following references were considered related:

U.S. Pat. No. 3,874,668, issued in the name of Flege, discloses a pendulum golf putter having a V-shaped handle at an intermediate position along the shaft and a C-shaped band for attachment to the upper arm of a user, wherein the pendulum golf putter is a one-arm putting device;

U.S. Pat. No. 3,963,244, issued in the name of Mierzejewski, discloses a pendulum golf putter comprising a pair of linearly elongated shafts coupled about a pivotal shank portion, wherein one shaft is secured to a putting surface and the other shaft (the putter) is used to strike a golf ball on the putting surface, pivotally rotating about the shank portion for the pendulum motion;

U.S. Pat. No. 4,298,201, issued in the name of Palinkas, discloses a golf alignment device for properly aligning a golfer's body and club along the correct or intended swing path, the device comprising a clip for attachment to a hat, a bar member and a linkage means connecting the clip to the bar member, with the bar member having a plurality of graduation marks for aligning the golfer properly;

U.S. Pat. No. 4,306,721, issued in the name of Doyle, discloses a golf putter with sighting device, wherein the sighting device is a wire pointer (directional arrow head) that is radially rotatable about the shaft of the putter;

U.S. Pat. No. 5,022,656, issued in the name of Tiller, discloses a training device for putting comprising a bar affixed to the putter shaft and having a free end connected a resilient tubing, wherein the resilient tubing resists putting motions inconsistent with a perpendicular path along the intended putting line;

U.S. Pat. No. 5,551,695, issued in the name of Wolk, discloses an apparatus for putter training comprising two elongated telescoping guides removably affixed to the head portion of a putter that induce striking of a golf ball therebetween; and U.S. Pat. No. 6,283,874, issued in the name of Studebaker, discloses a golf putter comprising a first and second shaft connecting together, wherein the second shaft has a bend in the top to provide stabilization while a user putts.

Consequently, a need has been felt for providing an improved golf putter that is fun to use and incorporated within a game.

SUMMARY OF THE INVENTION

It is therefore an object of the present invention to provide a telescopically adjustable putter mounted to a headband for use in a putting game.

It is another object of the present invention to provide a putter that is telescopically adjustable at various points along its shaft(s).

It is another object of the present invention to provide an adjustable headband receiving and impinging the putter for use in a putting game.

Briefly described according to one embodiment of the present invention, a telescopic putter mounted to a headband is a novelty game that mimics the game of golf. It is played indoors with a lightweight plastic ball and a cup resting on the floor. The game follows the general rules of putt-putt golf, except for the rule that the player must not touch the club with their hands when swinging. Instead the club is attached to the player's head with the use of a headband. Thus, the player must bend over the ball, place their hands on their knees and swing the club by turning their head from side to side. The club has an adjustable length shaft that telescopes in and out to accommodate players of varying heights. The headband is provided with a hook and loop fastener, such as VELCRO®, to accommodate the various head sizes of players of all ages.

An advantage of the present invention is that the apparatus and game provides a fun alternative to the standard putting games that can be played by golf enthusiasts, and the game does not require a vast amount of space for competition.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
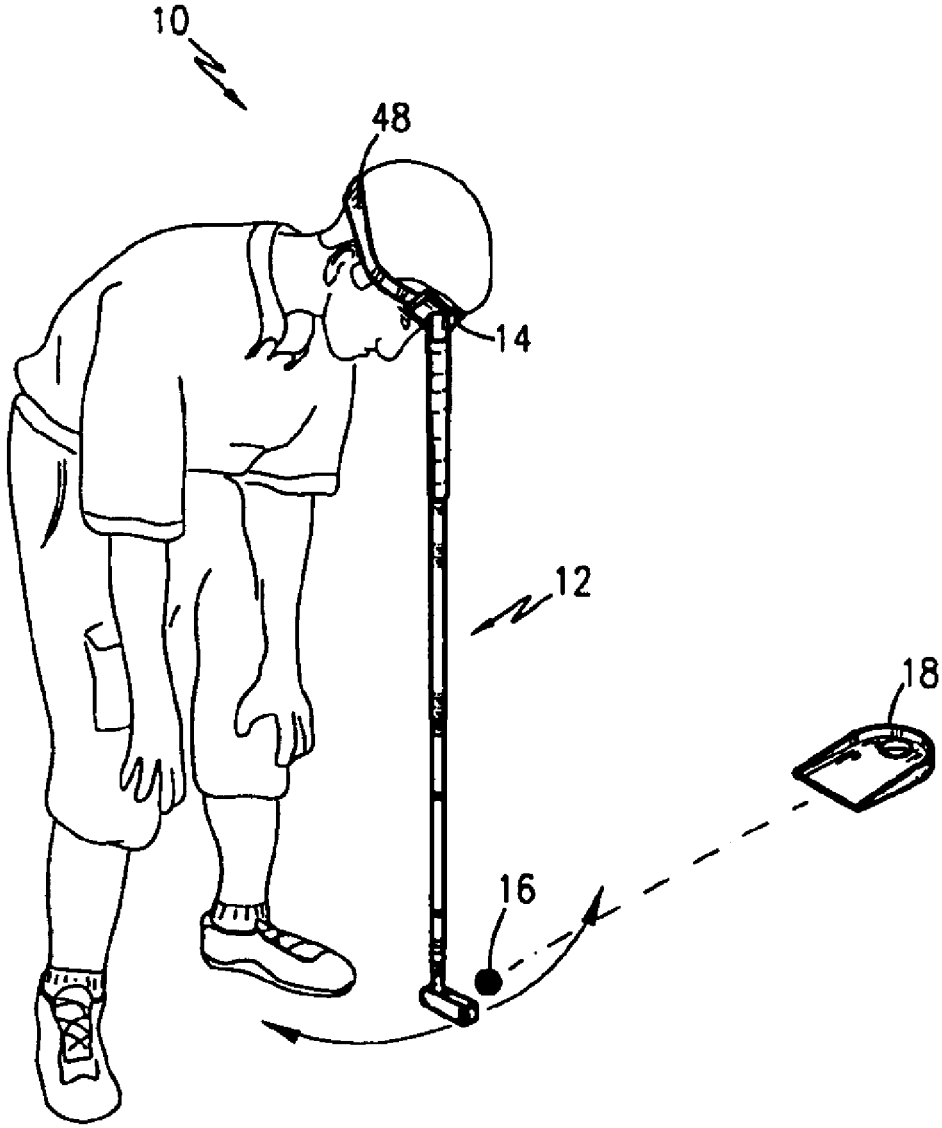
FIG. 1 is perspective view of a user with a telescopically adjustable putter mounted to a head, wherein the user is aligned with a golf ball and a cup.
Figure 2:
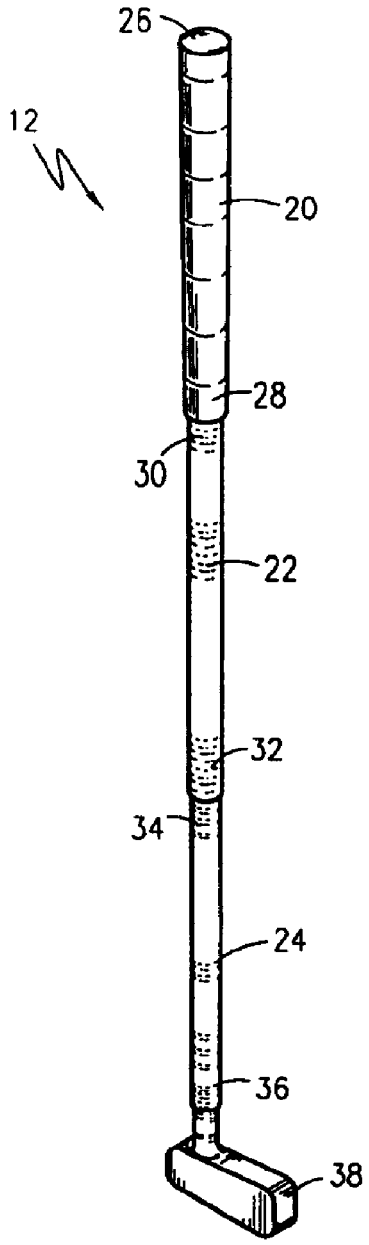
FIG. 2 is a perspective view of the putter with a plurality of shaft sections telescopically adjustable.
Figure 3:
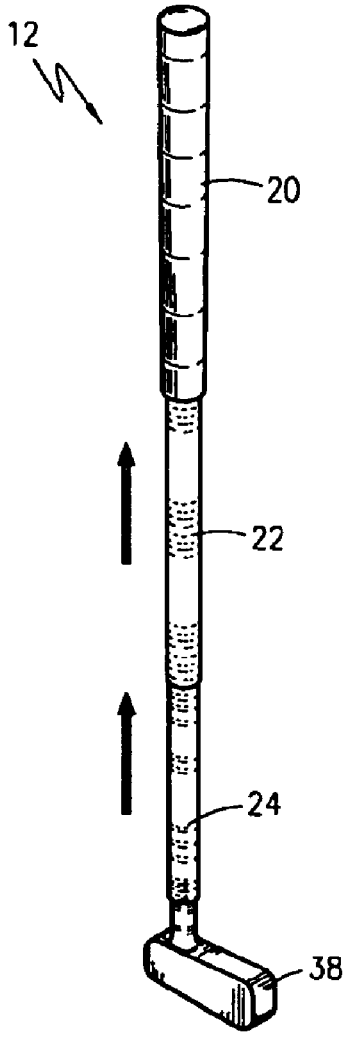
FIG. 3 is a perspective view of the putter telescopically shortened in length.

The best mode for carrying out the invention is presented in terms of its preferred embodiment, herein depicted within the FIGS. 1 through 10.

1. Detailed Description of the Figures

Referring now to FIG. 1 through FIG. 5, a telescopic putter mounted to a headband apparatus 10 is shown in accordance with a preferred embodiment of the present invention. The apparatus 10 comprises a linearly elongated, telescopically adjustable putter 12 removably affixed to a headband 14. The apparatus 10 is used in combination with a ball 16 and a cup 18, the rules of play further described below.

The putter 12 comprises a plurality of shaft sections 20, 22 and 24 (although more or less than three shaft sections are envisioned as providing the same or similar functionality) telescopically adjustable about one another. Each shaft section 20, 22 or 24 comprises a first end 26, 30 and 34, respectively, and a second end 28, 32 and 36, respectively. The first end 26 is insertably removable into the headband 14, and is further described below. The second end 28 is diametrically larger than the first end 30, thereby permitting telescopic adjustment of shaft sections 20 and 22. Likewise, the second end 32 is diametrically larger than the first end 34, also permitting telescopic adjustment of shaft sections 22 and 24. The telescopic ability of the shaft sections 20, 22 and 24 allow linear adjustment of the putter 12 over a length between a length just greater than the shaft section 20 to a length maximized by telescopic extension of all shaft sections 20, 22 and 24. The diametrical differences between second ends 28 and 32, respectively, in relation to the correspondingly insertable first ends 30 and 34, respectively, is only a slight difference and sized so that a shaft section 22 or 24 is frictionally impinged along the entire length of the shaft section 22 or 24, and telescopic adjustment requires more than a mere modicum of force in either direction, but instead requires sufficient force to overcome the frictionally impingement between shaft sections 20 and 22, and shaft sections 22 and 24, respectively. Alternatively, the shaft sections 20, 22 and 24 may be equipped with apertures and spring-biased snap fasteners for particularized telescopic adjustment and impingement of the shaft sections 20, 22 and 24. The second end 36 is coupled to a putter head 38, which may have a variety of configurations, including the blade-style depicted in the figures, cavity back or mallet (known in the art), and may also include offset or center mounted insertion of the second end 36 into the putter head 38. The putter head 38 is disposed at the lowest portion of the putter 12 as is standard with most putters 12.

Figure 4:
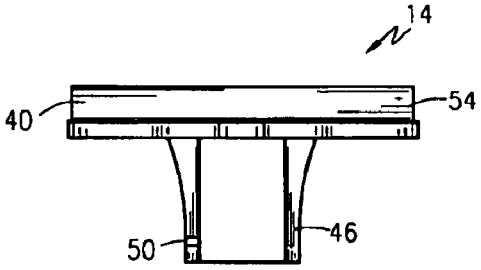
FIG. 4 is a side view of the headband.
Figure 5:
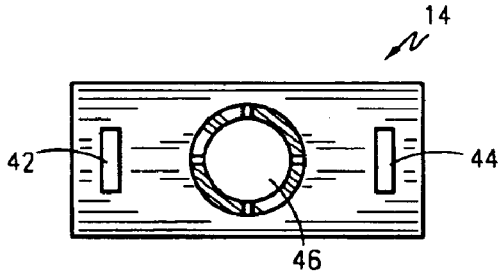
FIG. 5 is a top view of the headband.

As seen in FIG. 4 and FIG. 5, the headband 14 comprises an elongated band 40, having an anterior surface and a posterior surface, and further having a pair of apertures 42 and 44 and a retention housing 46. Each one of the pair of apertures 42 and 44 are formed substantially adjacent to the lateral margins of the elongated band 40. The apertures 42 and 44 receive a strap 48 for tightly and comfortably securing the headband 14 about the user's head. The strap 48 may have a variety of attachment means, including hook and loop material (VELCRO®), buttons, snaps or other similar items. The strap 48 is adjustable for accommodating small or large heads. The retention housing 46 is integral to the headband 14, arranged substantially at a mid-point between the lateral margins and substantially perpendicular to the plane of the headband 14 about the anterior surface. The retention housing 46 may be supported by a beveled collar or other bracing, thereby providing structural rigidity and support to the housing 46 during operation. The retention housing 46 receives the first end 26 of shaft section 20 through slidable forcible impingement. The retention housing 46 may have an orifice 50 alignable with a corresponding orifice 52 on shaft section 20, through which a snap pin or other impingement mechanism may be inserted to frictionally and forcefully impinge the putter 12 within the headband 14. It is envisioned that a spring-urged snap fastener may be integrally provided along the body of shaft section 20 so as to correspond with the orifice 50, thereby permitting spring-urged snap impingement of shaft section 20 to the retention housing 46. Other similar devices and fasteners may be employed for impinging shaft section 20 to the retention housing 46 without departing from the spirit of the invention. A pad 54 may be permanently adhered or removably affixed to the posterior surface of the headband 14 so as to provide a more comfortable fit and reduce the risk of skin irritation or injury.

Figure 6:
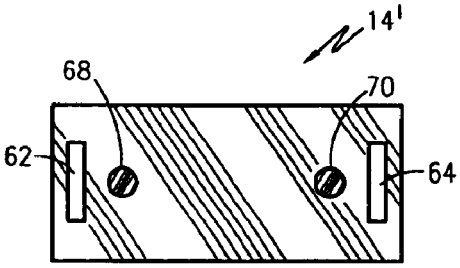
FIG. 6 is a top view of an alternative embodiment of the headband.
Figure 7:
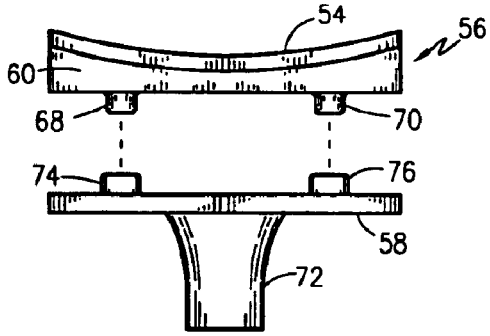
FIG. 7 is a side view of an alternative embodiment of the headband.

Referring now to FIG. 6 and FIG. 7, an alternative embodiment of the headband 14' is shown. The alternative headband 14' comprises two bodies 56 and 58 fittingly coupled. Body 56 is an elongated band 60 having an anterior surface and a posterior surface, and comprising a pair of apertures 62 and 64 formed substantially adjacent to the lateral margins of the elongated band 60. The apertures 62 and 64 receive a strap (similar to strap 48) for tightly and comfortably securing the headband 14' about the user's head. The band 60 further includes a pair of posts 68 and 70 for attachment to body 58, the posts 68 and 70 projecting from the anterior surface of body 56. Body 58 is an elongated body coextensive with body 56, also having an anterior surface and a posterior surface, and comprises a retention housing 72 (similar to retention housing 46 in form and function, the description of which is hereby incorporated by reference) arranged substantially at a mid-point between the lateral margins and substantially perpendicular to the plane of the headband 14' about the anterior surface. The retention housing 72 receives the first end 26 of shaft section 20. Body 58 further includes a pair of caps 74 and 76 projecting from the posterior surface of body 58 and forcibly coupled with posts 68 and 70, respectively, so as to couple body 56 to body 58. It is further envisioned that coupling of posts 68 and 70 with caps 74 and 76 may be accomplished through other coupling mechanisms, including integral threads, insertable screws, snap fasteners or other similar items.

Figure 8:
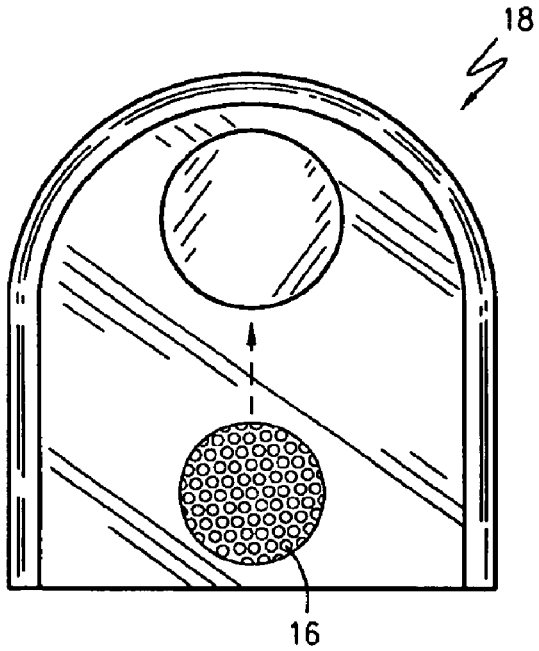
FIG. 8 is a plan view of a cup and a ball entering the cup.

Referring now to FIG. 8, the ball 16 is envisioned to be of similar dimensions to a standard golf ball, or approximately 1.68 inches, or 4.27 centimeters, according to United States Golf Association (USGA) guidelines. As such, the diameter of the ball is envisioned to fall within the diametrical range of one (1) to two (2) inches (2.54 centimeters to 5.08 centimeters). The ball 16 may be manufactured from a number of materials, including natural or synthetic rubbers of a hardened quality, soft, thermoplastic polymers (including SURLYN® or balata-based), polybutadiene, or other similar compounds and substances used in standard golf ball manufacturing. Furthermore, the ball 16 may be manufactured as a plastic ball with or without dimples, wherein the plastic used is similar to that used in WIFFLE® balls, having a hollow center.

The cup 18 is envisioned to be between four (4) and five (5) inches wide (10.2 centimeters and 12.7 centimeters) and between four (4) and six (6) inches deep (10.2 centimeters and 15.2 centimeters). The cup 18 may have a variety of overall configurations, including the key-shape depicted in the figures, having a linear front and curvilinear sides (orthogonal configurations are also envisioned). To add to the degree of difficulty, and requiring greater or advanced skill, the cup 18 may include an inclined surface terminating with an indentation or opening for simulating a standard golf cup and requiring repository of the ball 16 for successfully completing the challenge.

Figure 9:
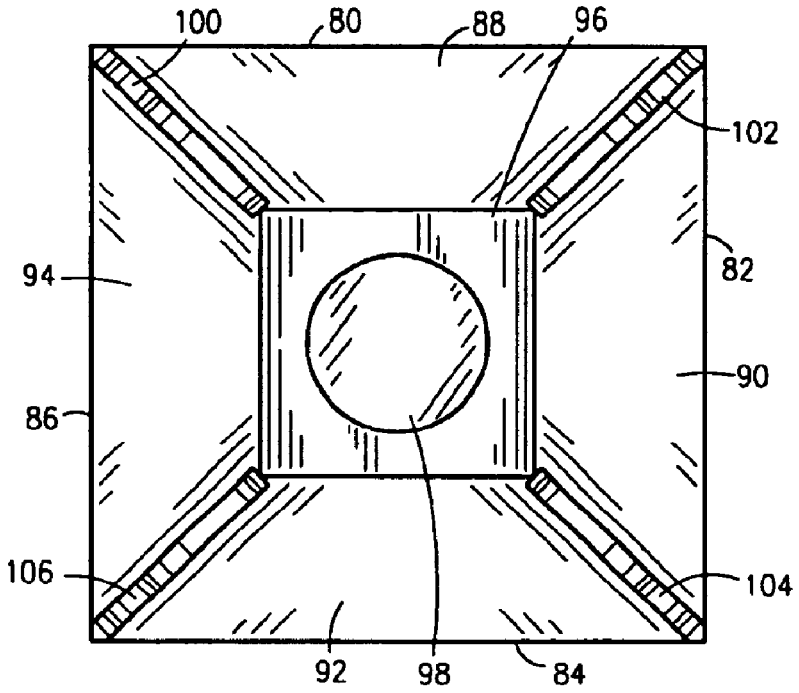
FIG. 9 is a top plan view of an alternative embodiment of a cup.
Figure 10:
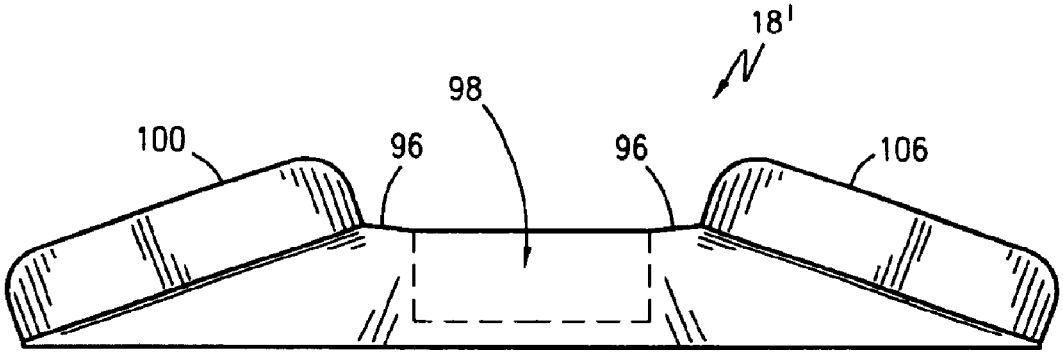
FIG. 10 is a side view of the alternative cup of FIG. 9.

Referring now to FIG. 9 and FIG. 10, an alternative embodiment of the cup 18' is shown. The alternative cup 18' comprises a four-sided orthogonal perimeter 80, 82, 84 and 86, wherein each of the four sides 80, 82, 84 and 86 includes a corresponding inclined surface (ramp) 88, 90, 92 and 94. Each surface (ramp) 88, 90, 92 and 94 is adjacently disposed to a declined platform 96, each surface (ramp) 88, 90, 92 and 94 accessing a different side of the platform 96. Centrally integral to the platform 96 is a recessed opening 98 for receiving a golf ball, wherein the slightly declined platform 96 permits a struck golf ball to continue toward the opening 98. In the embodiment depicted in FIG. 9 and FIG. 10, the platform 96 is substantially orthogonal, and the opening 98 is cylindrical in shape. However, the platform 96 and the opening 98 is envisioned to be available in a variety of shapes and forms. Each of the four sides 80, 82, 84 and 86 is separated from the adjacent sides by a wing 100, 102, 104 and 106. Each respective wing 100, 102, 104 and 106 is positioned to align between the corners of the four-sided orthogonal perimeter 80, 82, 84 and 86 linearly along the inclined surfaces (ramps) 88, 90, 92 and 94 and the corners of the platform 96. The wings 100, 102, 104 and 106 are included so as to provide a guide along the surfaces (ramps) 88, 90, 92 and 94 for putts that are not directly on line to the opening 98. The cups 18 and/or 18' may be manufactured from a variety of durable substances that permit repeated insertion and extraction of golf balls of a variety of compositions. Included among the materials ideal for the cups 18 and/or 18' is plastic, hardened rubber, metal or other similar materials.

The rules of the putting game incorporating the apparatus 10 previously described include the following steps:

a. Determining a starting position at which all challengers will hit their first putt from;

b. Placing the cup a specified distance from the starting position;

c. Attaching headband to user's head;

d. Placing ball at starting position;

e. Attaching putter to headband;

f. Adjusting length of putter shaft;

g. Aligning putter with ball along a specified target path;

h. Placing user's hands on knees;

i. Rotating head to generate pendulum motion of putter stroke;

j. Striking ball toward cup;

k. Repeating (a) through (j) until ball is secured within cup; and l. Repeating (a) through (k) until specified number of holes is completed.

The winner of the challenge is the user that finishes the specified number of holes in the least amount of strokes.

2. Operation of the Preferred Embodiment

A user will attach the headband 14 to the user's head and adjust the diameter of the headband 14 according to the user's head size and using the strap 48 and adjustment mechanisms provided. After placement of ball 16, the user will align the still detached putter 12 and telescopically adjust the length of the shafts 20, 22 and 24 accordingly. After determining the appropriate length of the shafts 20, 22 and 24, the putter 12 may be inserted into the retention housing 46 for secured impingement therein. The user may then rotate the user's head so as to create a pendulum motion for striking the ball 16 toward a target, such as a cup 18.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A method of playing a golf putting game with an apparatus, said apparatus having a telescopically adjustable putter mounted to a headband, said game comprising the steps of:

selecting a starting position from which all challengers will strike a golf ball toward a golf cup;

attaching said apparatus to a challenger's head;

aligning said putter to said ball along a specified target path;

rotating head of challenger to generate pendulum motion of putter stroke;

striking said ball toward said cup;

repeating until said ball is secured within said cup.

2. The method of claim 1 further comprising the step of selecting a specified number of holes to be completed by said challengers.

3. The method of claim 2 further comprising the step of repeating the steps of claim 1 until said specified number of holes are completed.

4. The method of claim 1 further comprising the step of selecting a distance at which said cup is placed from said starting position.

5. The method of claim 1 further comprising the step of adjusting the length of said putter.

6. The method of claim 1 further comprising the step of placing said ball at said starting position.

7. The method of claim 1 further comprising the step of placing user's hands on knees before rotating the head to strike said ball.

* * * * *